US006414424B1

(12) United States Patent
Amano

(10) Patent No.: US 6,414,424 B1
(45) Date of Patent: Jul. 2, 2002

(54) ELECTRON GUN, COLOR CATHODE RAY TUBE, AND DISPLAY APPARATUS USING SAME

(75) Inventor: Yasunobu Amano, Tokyo (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/499,582

(22) Filed: Feb. 7, 2000

(30) Foreign Application Priority Data

Feb. 24, 1999 (JP) ..... 11-045881
Dec. 20, 1999 (JP) ..... 11-360150

(51) Int. Cl.[7] ..... H01J 29/48; H01J 29/46; H01J 29/51

(52) U.S. Cl. ..... 313/414; 313/449; 313/447; 315/382.1

(58) Field of Search ..... 313/414, 412, 313/447, 449, 452; 315/368.16, 368.15, 382.1, 382

(56) References Cited

U.S. PATENT DOCUMENTS 5,217,833 A 6/1993 Yamanaka et al.
5,350,978 A * 9/1994 Chen ..... 313/409
5,399,932 A * 3/1995 Anzai et al. ..... 313/414
5,689,158 A * 11/1997 Chen ..... 313/409

FOREIGN PATENT DOCUMENTS

EP 0641010 * 1/1995 ..... H01J/29/50
JP 58023144 2/1983
JP 08-185809 A 7/1996
JP 11-067121 9/1999
WO WO 94/18691 8/1994
WO WO 96/08032 3/1996

* cited by examiner

*Primary Examiner*—Nimeshkumar D. Patel
*Assistant Examiner*—Karabi Guharay
(74) *Attorney, Agent, or Firm*—Rader, Fishman, & Grauer PLLC; Ronald P. Kananen, Esq.

(57) ABSTRACT

In an inline type electron gun incorporated in a color cathode ray tube, a plurality of electron beams are produced from each of cathodes. A plurality of beam apertures are formed, per cathode, in a first grid and a second grid of the electron gun. The second grid consists of a plurality of split grids spaced apart from each other in the traveling direction of electron beams. The beam apertures formed in at least one of the split grids constituting the second grid are positionally eccentric to the beam apertures formed in another split grid. A voltage of a waveform synchronized with a deflection period is impressed from a circuit in a display apparatus to at least one of the split grids constituting the second grid. And the electron lens effect of the second grid is changed in accordance with the impressed voltage waveform, thereby correcting the positional deviation of the plural electron beams caused in the peripheral area of a fluorescent screen.

7 Claims, 5 Drawing Sheets

FIG. 1 PRIOR ART
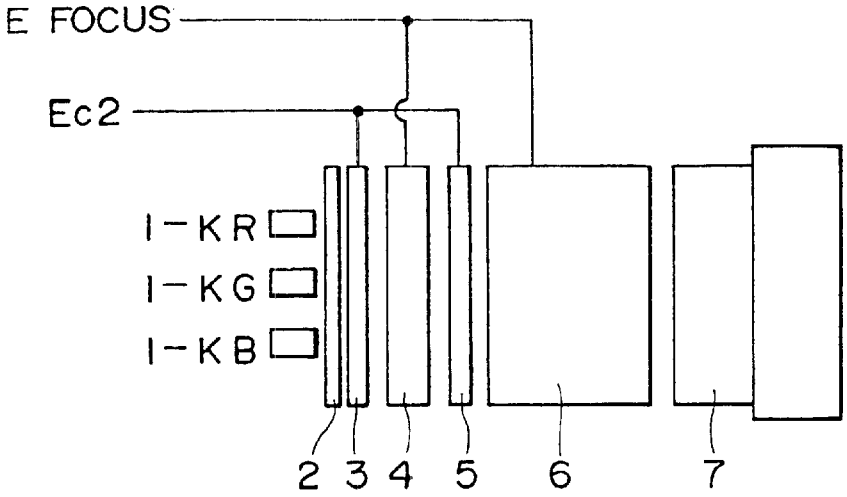
FIG. 2 PRIOR ART
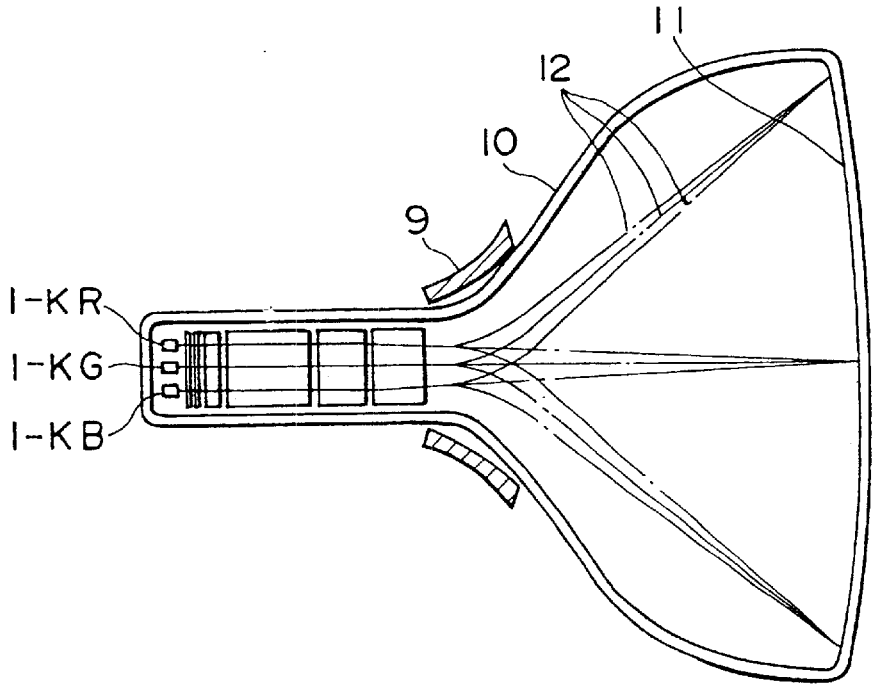

BH: BEAM APERTURE

ELECTRON GUN, COLOR CATHODE RAY TUBE, AND DISPLAY APPARATUS USING SAME

BACKGROUND OF THE INVENTION

The present invention relates to an electron gun, a color cathode ray tube and a display apparatus, and more particularly to an inline type electron gun capable of producing a plurality of electron beams from each of cathodes, a color cathode ray tube using such an electron gun, and also to a display apparatus using the same.

As shown in FIG. 1, a conventional electron gun 8 employed in a known color cathode ray tube has three cathodes.

A cathode 1-KR is used for displaying red, a cathode 1-KG for displaying green, and another cathode 1-KB for displaying blue, respectively.

Electrons generated in the individual cathodes are accelerated by grids 2–7 to form three electron beams.

Each of the electron beams is irradiated onto a fluorescent screen of the cathode ray tube.

The electron beams collide with red, green and blue fluorescent materials, and light is generated at the points of such collision.

As shown in FIG. 2, a deflection yoke 9 is attached to the outside of a glass bulb 10 of the cathode ray tube.

Currents of horizontal and vertical deflection periods are caused to flow in the deflection yoke 9 by circuits incorporated in a display apparatus.

The deflection yoke 9 generates magnetic fields in accordance with such currents, so that the electron beams 12 are deflected in both horizontal and vertical directions.

The fluorescent screen 11 of the cathode ray tube are scanned by the electron beams to display an image thereon.

In order to enhance the luminance of the image in the cathode ray tube, it is necessary to increase the current quantity of the electron beams.

According to the related art, it has been customary heretofore that one electron beam is produced from one cathode.

The diameter of an electron beam tends to become greater with an increase of the current quantity.

For this reason, there exists a relationship that the resolution of an image is deteriorated as the luminance thereof becomes higher.

Accordingly, some limitation is unavoidable in raising the luminance while maintaining the resolution to a certain extent.

For the purpose of solving the above problem, an improvement has been contrived to produce a plurality of electron beams per color so as to raise the luminance without inducing deterioration of the resolution. In this case, the plurality of electron beams are irradiated in respective directions slightly different from one another.

In a process of employing two electron beams per color for example, there have been tried a variety of methods inclusive of one that produces six electron beams from six cathodes, or one that produces two electron beams from each of three cathodes.

However, the above method of increasing the number of cathodes to six raises a problem in carrying into effects practically since some difficulties are existent in realizing a dimensional reduction of the electron gun.

Further, any of the known methods mentioned above brings about a problem that it is difficult to attain a positional coincidence between electron beams on the fluorescent screen.

More specifically, the positions where two electron beams per color collide with the fluorescent screen need to be mutually coincident.

And if the positional deviation is great, it causes deterioration of the image resolution.

As obvious from FIG. 2, the distance required for any traveling electron beam to reach the fluorescent screen is different in the central area and the peripheral area of the screen.

That is, the distance of travel required for any electron beam to reach the peripheral area of the fluorescent screen is longer than the distance required for the electron beam to reach the central area of the fluorescent beam.

Therefore, even if the setting is so determined that the positions of collision of two electron beams are mutually coincident in the central area of the fluorescent screen, the two electron beams positionally coincide, in the peripheral area of the fluorescent screen, at points anterior to the fluorescent screen.

Consequently, a positional deviation occurs between the two electrodes in the peripheral area of the fluorescent screen.

As a result, it has been difficult heretofore to attain a positional coincidence between the electron beams on the entire fluorescent screen.

SUMMARY OF THE INVENTION

In view of the problems described above, it is an object of the present invention to realize an improved inline type electron gun which produces a plurality of electron beams from each of cathodes and ensures a positional coincidence between the plurality of electron beams over the entire area of a fluorescent screen. Another object of the present invention resides in providing a color cathode ray tube using such an inline type electron gun. And a further object of the present invention is to provide a display apparatus equipped with such a color cathode ray tube using the electron gun of the invention.

According to one aspect of the present invention, there is provided an inline type electron gun comprising three cathodes. In first and second grids of this electron gun, a plurality of beam apertures are formed per cathode. The optimal number of electron beams produced from each cathode is two or three.

The second grid is split into a plurality of grids which are spaced apart mutually in the traveling direction of the electron beams. The optimal number of such split grids is two or three.

The beam apertures in at least one of the split grids are so formed as to be eccentric to the beam apertures in the other split grid.

And a voltage generated by a circuit in the display apparatus and changed synchronously with the deflection period is impressed to at least one of the split grids.

In the first and second grids, a plurality of beam apertures are formed per cathode, and a plurality of electron beams are produced from each of the cathodes.

The second grid is split into a plurality of grids, and the beam apertures in at least one split grid are formed to be eccentric to those in the other split grid.

Consequently, any electron beam passing through the second grid is curved by the field lens effect between the grids.

When the voltage of a waveform synchronized with the deflection of the electron beam is impressed to at least one of the split grids, the field lens effect is changed in accordance with the impressed voltage.

More specifically, the quantity of curvature of the electron beam is changed in conformity with the voltage waveform in the grid.

Normally, the positional deviation between the plural electron beams includes both horizontal and vertical components. In order to correct these two components, a beam aperture having a vertical eccentricity is formed in, for example, one split second grid, while a beam aperture having a horizontal eccentricity is formed in another split second grid. And the voltages of waveforms changed synchronously with the deflection period are impressed to such two split grids independently of each other.

If the waveforms of the voltages impressed to the two split grids are optimized by properly controlling the circuits in a display apparatus, then it becomes possible to attain a positional coincidence in collision of plural electron beams over the entire area of the fluorescent screen.

The above and other features and advantages of the present invention will become apparent from the following description which will be given with reference to the illustrative accompanying drawings.

BRIEF DESCRIPTION OF THE DRAWINGS

FIG. 1 is a plan view of an exemplary known electron gun used in a conventional color cathode ray tube according to the related art;

FIG. 2 is a sectional view showing the structure of a color cathode ray tube;

DETAILED DESCRIPTION OF THE PREFERRED EMBODIMENTS

Hereinafter some preferred embodiments of the present invention will be described with reference to the accompanying drawings.

First, a detailed explanation will be given on a first embodiment of the invention.

Figure 3A:
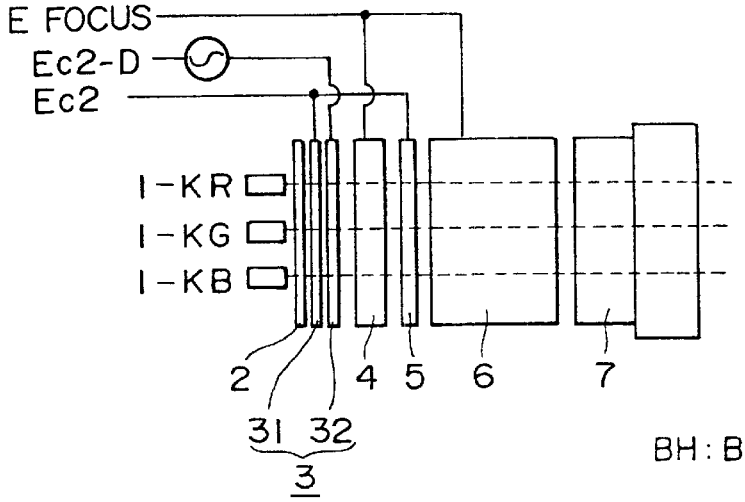
FIG. 3A is a plan view showing a first embodiment of an electron gun where the present invention is applied.

In FIG. 3A, there are shown a cathode 1-KR used for displaying red, a cathode 1-KG for displaying green, and a cathode 1-KB for displaying blue, respectively.

Electrons generated in the individual cathodes are accelerated by grids 4–7 to form electron beams.

Figure 3B:
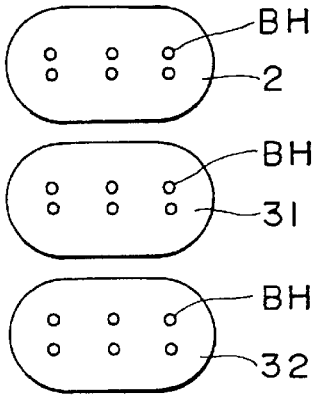
FIG. 3B is a front view of first and second grids in the first embodiment.

Reference numeral 2 denotes a first electrode, where two beam apertures are formed per cathode, as shown in FIG. 3B. That is, a total of six beam apertures are formed correspondingly to the three cathodes.

In this embodiment, the two beam apertures formed per cathode are spaced apart vertically from each other.

As shown in FIG. 3A, a second grid 3 consists of split grids 31 and 32. More specifically, the second grid 3 is composed of two split grids which are spaced apart from each other in the traveling direction of electron beams.

In one split grid 31 proximate to the first grid 2, beam apertures are formed at positions corresponding to the beam apertures formed in the first grid 2, as shown in FIG. 3B. Meanwhile in another split grid 32 faraway from the first grid 2, beam apertures are formed at positions slightly eccentric with regard to the beam apertures formed in the first grid 2 and the split grid 31. The direction of such eccentricity is upward with respect to the upper beam aperture, or downward with respect to the lower beam aperture. Video signals of individual colors are applied to the cathodes 1 respectively. In this embodiment, the first grid 2 is grounded.

A DC voltage Ec2 of, e.g., +200–+800 V or so is impressed to the split grid 31 constituting the second grid 3. The grids 31 and 5 are connected electrically to each other.

Figure 3C:
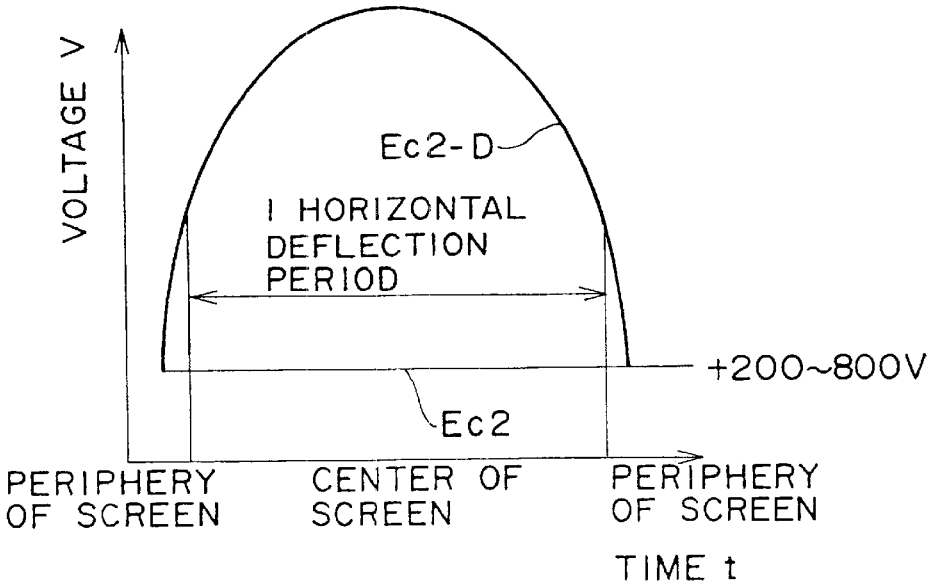
FIG. 3C graphically shows the waveform of a voltage impressed to each of split grids constituting the second grid in the first embodiment.

And a voltage changed synchronously with a deflection period is impressed to the split grid 32 which constitutes the second grid 3. More concretely, as shown in FIG. 3C, there is impressed a combination of a DC voltage and an inverse parabolic voltage changed synchronously with a horizontal deflection period.

In this electron gun, it is possible to correct the positional deviation of two electron beams caused in the left and right peripheral areas of the fluorescent screen.

Figure 4:
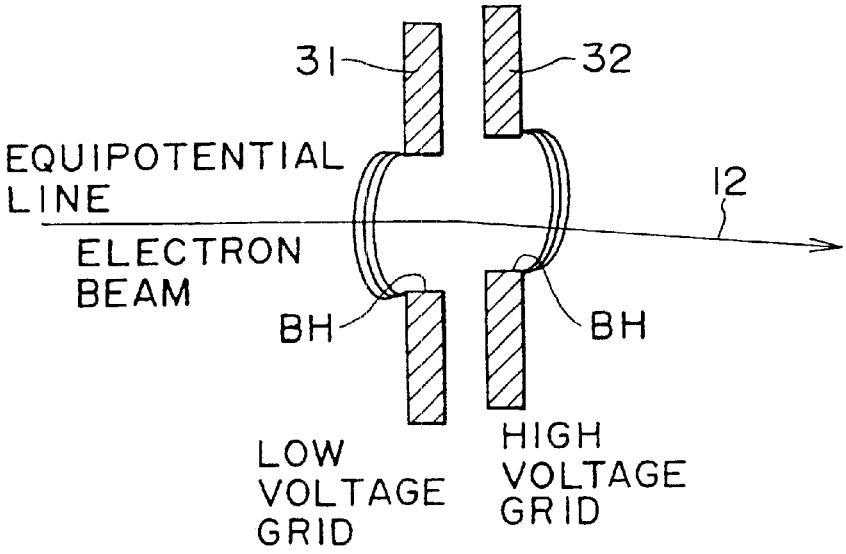
FIG. 4 illustrates how an electron beam having passed through an eccentric beam aperture is curved in its travel direction.

As illustrated in FIG. 4, if the beam aperture in the split grid 32 is deviated upward from the beam aperture in the split grid 31, then any electron beam passing therethrough is curved downward by the electron lens effect, because the electron beam is affected by a force acting in the direction normal to an equipotential line.

On the contrary, in case the beam aperture in the split grid 32 is deviated downward, then any electron beam passing therethrough is curved upward.

The angle of such curvature of the electron beam is varied depending on the voltages impressed to the split grids 31 and 32.

In the embodiment shown in FIG. 3B, the electron beam having passed through the upper beam aperture in the split grid 32 is curved downward, while the electron beam having passed through the lower beam aperture in the split grid 32 is curved upward. Thus, the split grid 32 converges the two electron beams emitted from one cathode.

Since the inverse parabolic voltage Ec2-D is impressed to the split grid 32, the electron lens effect of the split grid 32 is rendered greater when the electron beam collides with the central area of the fluorescent screen.

Meanwhile, when the electron beam collides with the peripheral area of the fluorescent screen, the electron lens effect of the split grid 32 is weakened in accordance with the quantity of its horizontal deflection. That is, the effect exerted by the split grid 32 is rendered smaller.

The vertical component, which is included in the entire positional deviation of the two electron beams caused in the peripheral area of the fluorescent screen, is corrected by a change of the effect of the split grid 32. Consequently, it becomes possible to attain, in the peripheral area of the fluorescent screen, a positional coincidence between the two electron beams emitted from the same cathode.

The operation mentioned above is performed in an exemplary case where an inverse parabolic voltage synchronized with the horizontal deflection period is impressed to the split grid 32.

Practically, however, the voltage waveform impressed to the split grid 32 needs to be set individually in conformity with the kind of each color cathode ray tube.

That is, the voltage impressed to the split grid 32 is not limited merely to one changed in compliance with the horizontal deflection period alone, and such voltage may be one changed in compliance with both the horizontal deflection period and the vertical deflection period, or one changed in compliance with only the vertical deflection period.

In a color cathode ray tube employing the above electron gun, its fluorescent screen is scanned by two electron beams per color.

Consequently, the luminance can be enhanced approximately twice the known value without inducing any harmful influence on the resolution. If the luminance is set to be equal to the conventional one, then the required current of one electron beam is reduced to a half in comparison with the known value.

Since this signifies that the driving voltage can be lowered, it becomes possible to reduce the power consumption.

Figure 5:
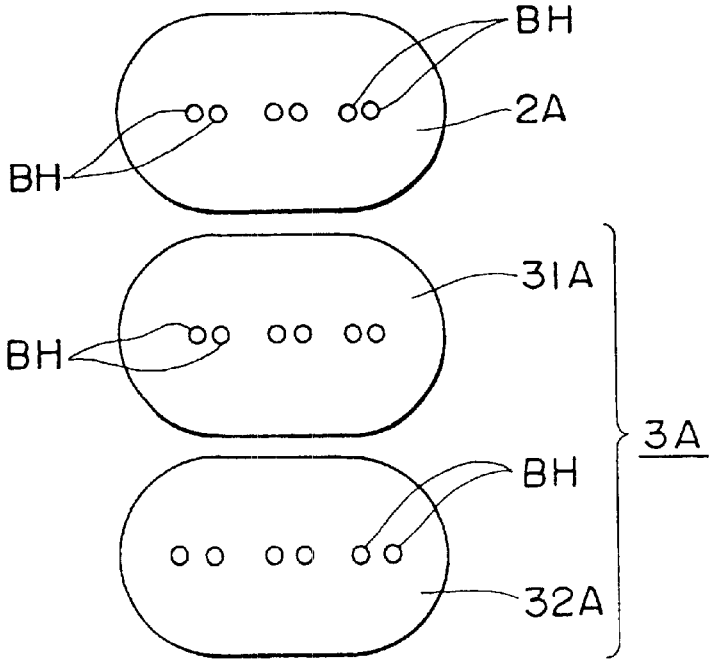
FIG. 5 is a front view showing a first modification of the first and second grids in the first embodiment.

FIG. 5 shows grids used in a modification of the first embodiment.

In this modification, two beam apertures formed per cathode are spaced apart horizontally from each other.

The beam apertures in the first grid 2A and those in the split grid 31A are so positioned as not to be eccentric to each other. Meanwhile the beam apertures in the split grid 32A are positioned to be eccentric outward respectively.

In this structure, one of two electron beams passing through the left beam aperture is curved rightward, while the other electron beam passing through the right beam aperture is curved leftward.

The process of impressing the voltages to the grids of the electron gun, particularly to the split grids 31A and 32A of the second grid 3A, may be the same as that in the aforementioned embodiment of FIG. 3.

In this modification, the horizontal deviation, which is included in the entire positional deviation of the two electron beams caused in the left and right peripheral areas of the fluorescent screen, is corrected by a change of the convergence effect of the split grid 32.

Figure 6A:
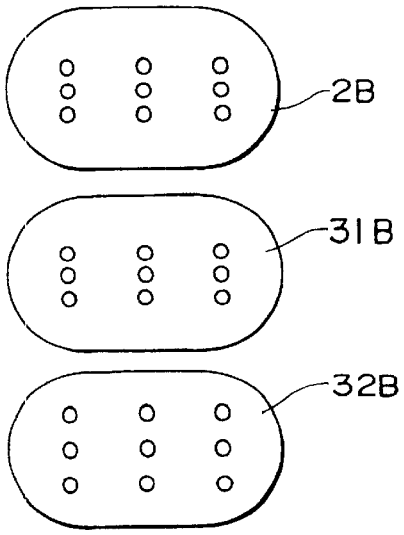
FIG. 6A is a front view showing a second modification of the first and second grids in the first embodiment.
Figure 6B:
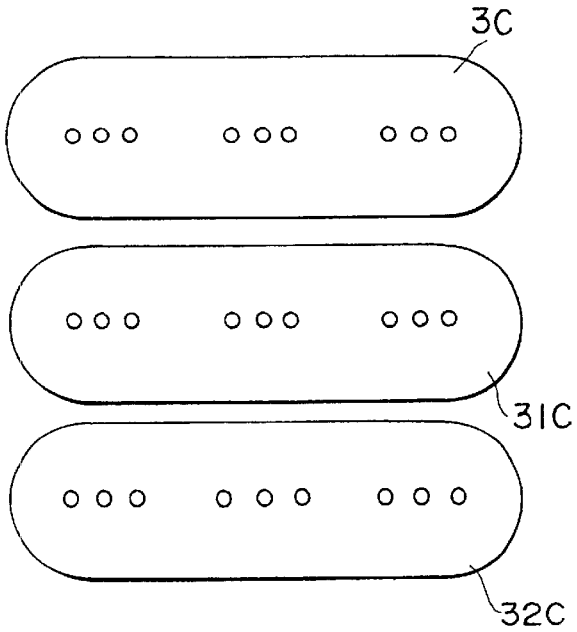
FIG. 6B is a front view showing a third modification of the first and second grids in the first embodiment.

FIGS. 6A and 6B show grids used in another modification of the first embodiment. FIG. 6A represents a case where three beam apertures corresponding to each cathode are arrayed vertically, and FIG. 6B represents another case where three beam apertures are arrayed horizontally.

In either example, the center aperture out of the three beam apertures for the relevant cathode is not eccentric to the first and second grids. And the upper and lower beam apertures or the left and right ones are formed eccentrically in the same manner as those shown in FIGS. 3B or 4.

In this structure, three electron beams are usable for displaying each color. Consequently, the effect attainable therein is rendered superior to the effect achieved by the use of two electron beams for each color.

The first embodiment and some modifications thereof have been described hereinabove.

Next, an explanation will be given on a second embodiment of the present invention.

Figure 7A:
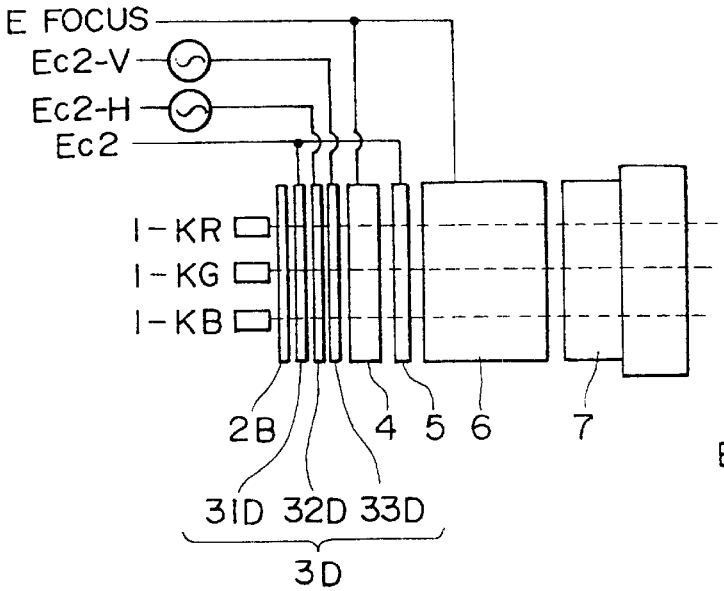
FIG. 7A is a plan view showing a second embodiment of an electron gun where the present invention is applied.

The first embodiment is so contrived as to correct the positional deviation caused either horizontally or vertically. According to the second embodiment shown in FIGS. 7A and 7B, it is possible to correct both horizontal and vertical positional deviations.

The second embodiment includes some component elements common to those employed in the foregoing first embodiment. Since the common elements have already been described, a repeated explanation thereof is omitted here, and a description will be given only on different elements.

In the second embodiment, a second grid 3D consists of three split grids 31D, 32D and 33D. And two beam apertures per cathode are formed in each of a first grid 2D and the three split grids 31D, 32D and 33D.

The two beam apertures are spaced apart from each other both vertically and horizontally, i.e., in an oblique direction.

In each of the first grid 2D and the split grid 31D, the two beam apertures BH, BH formed per cathode are spaced apart from each other in a direction parallel with, e.g., the diagonal line of the fluorescent screen. The two beam apertures BH, BH in the first grid 2D and those in the split grid 31D are so positioned as to correspond mutually without any eccentricity.

Meanwhile the two beam apertures formed per cathode in the split grid 32D of the second grid 3D are positioned with a horizontally outward eccentricity to the two beam apertures BH, BH formed in the first split grid 31D. More specifically, the left (obliquely left) beam aperture BH in the split grid 32D has a horizontally leftward eccentricity to the beam aperture BH in the first split grid 31D, while the right (obliquely right) beam aperture BH in the split grid 32D has a horizontally rightward eccentricity to the beam aperture BH in the split grid 31D.

Further the two beam apertures BH, BH formed per cathode in the third split grid 33D are positioned with a vertically outward eccentricity to the two beam apertures BH, BH formed per cathode in the split grid 32D. More specifically, the lower (obliquely lower) beam aperture BH in the split grid 32D has a vertically downward eccentricity to the beam aperture BH in the split grid 31D, while the upper (obliquely upper) beam aperture BH in the split grid 32D has a vertically upward eccentricity to the beam aperture BH in the split grid 31D.

A DC voltage Ec2 of, e.g., +200–+800 V or so is impressed to the split grid 31D. Meanwhile, a voltage of a waveform synchronized with the horizontal deflection as shown in FIG. 3C is impressed to the split grid 32D, and also a voltage of another waveform synchronized with the horizontal deflection is impressed to another split grid 33D as well. The individual voltage waveforms impressed to the split grids 32D and 33D are controllable independently of each other.

According to the inline type electron gun or the color cathode ray tube using the same as described, it is possible to correct the horizontal positional deviation of electron beams by the lens effects of the split grids 31D and 32D. It is further possible to correct the vertical positional deviation of electron beams by the lens effects achieved due to the vertical eccentricity of the beam apertures in the split grids 32D and 33D.

Consequently, in the peripheral area of the fluorescent screen, a more complete positional coincidence is attained between the two electron beams relative to each cathode.

Practically, however, the voltage waveforms impressed to the split grids 32D and 33D need to be set individually in conformity with the kind of the color cathode ray tube, as in the foregoing first embodiment.

That is, either of the voltages impressed to the split grids 32D and 33D is not limited merely to one changed in compliance with the horizontal deflection period alone, and such voltage may be one changed in compliance with both the horizontal deflection period and the vertical deflection period, or one changed in compliance with only the vertical deflection period.

Figure 7B:
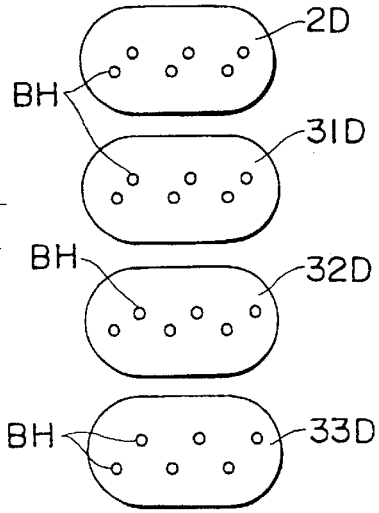
FIG. 7B is a front view of first and second grids in the second embodiment.

In FIG. 7B, another beam aperture BH may be formed at a midpoint between the two beam apertures BH formed per cathode in the first grid 2D and each of the the split grids 31D, 32D and 33D of the second grid 3D. In this case, the middle beam aperture BH need not have any eccentricity since it is not necessary to exert lens effect on the electron beam passing therethrough.

Due to such a structure, three electron beams can be produced from each cathode.

In the second embodiment of FIG. 7B, a horizontal eccentricity is created between the beam apertures formed respectively in the split grids 31D and 32D, and a vertical eccentricity is created between the beam apertures in the split grids 32D and 33D. However, such arrangement of the apertures is not exactly requisite, and the beam aperture in the split grid 32D may be vertically eccentric to the one in the split grid 31D, and the beam aperture in the split grid 33D may be horizontally eccentric to the one in the split grid 32D. In other words, the order of such horizontal and vertical eccentricities is not fixed and may be freely selectable. The above is the explanation of a second embodiment of the present invention.

Figure 8A:
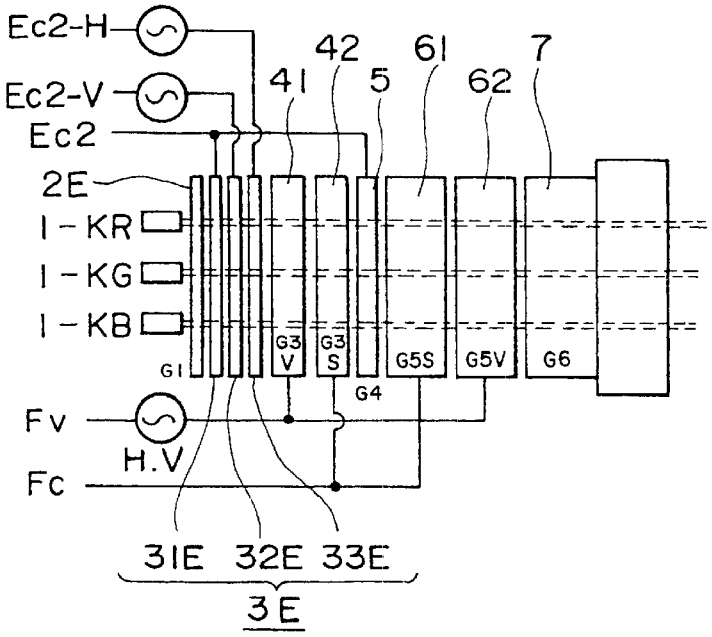
FIG. 8A is a plan view showing a third embodiment of an electron gun where the present invention is applied.
Figure 8B:
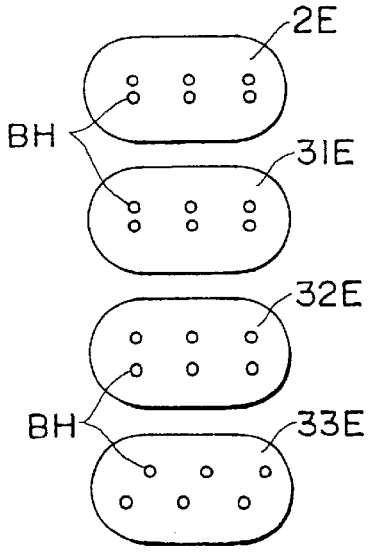
FIG. 8B is a front view of the first and second grids in the third embodiment.

Now an explanation will be given on a third embodiment of the present invention which is shown in FIGS. 8A and 8B.

Similarly to the second embodiment mentioned above, it is possible in the third embodiment also to correct both horizontal and vertical deviations.

The third embodiment includes some component elements common to those used in the foregoing second embodiment. Since the common elements have already been described, a repeated explanation thereof is omitted here, and a description will be given only on different elements.

In the third embodiment, a second grid 3E consists of three split grids 31E, 32E and 33E. And two beam apertures per cathode are formed in each of a first grid 2E and the three split grids 31E, 32E and 33E.

The beam apertures in the first grid 2E and the split grid 31E are so formed as to have none of mutual eccentricity.

The above points are common to the aforementioned second embodiment.

However, one difference resides in the point that the beam apertures in the split grid 32E are formed to be vertically eccentric to the beam apertures in the split grid 31E. Another difference is that the beam apertures in the split grid 33E are formed to be horizontally eccentric to the beam apertures in the split grid 32E.

And a further difference resides in the point that a voltage for correcting the vertical deviation of an electron beam is impressed to the split grid 32E, while a voltage for correcting the horizontal deviation of an electron beam is impressed to the split grid 33E.

A third grid 4 consists of two split grids 41 and 42, and a fifth grid 6 also consists of two split grids 61 and 62.

And voltages of waveforms synchronized with the deflection period are impressed to the split grids 41 and 62, whereby the electron beam focusing performance is enhanced in the peripheral area of the fluorescent screen.

Thus, the present invention can be embodied in a variety of modes with various modifications.

In any of the above embodiments, it is possible to produce a plurality of electron beams from each of the cathodes. And any positional deviation between the plural electron beams can be corrected properly, hence raising the luminance of the image without deterioration of its resolution. This signifies that the required driving voltage can be lowered to obtain the same luminance.

Further in the second and third embodiments, both horizontal and vertical deviations are correctable with accuracy to consequently realize an enhanced precision in correcting the positional deviation between a plurality of electron beams.

Although the present invention has been described hereinabove with reference to some preferred embodiments thereof, it is to be understood that the invention is not limited to such embodiments alone, and a variety of other changes and modifications will be apparent to those skilled in the art without departing from the spirit of the invention.

The scope of the invention, therefore, is to be determined solely by the appended claims.

What is claimed is:

1. An inline type electron gun comprising:

three cathodes;

a first grid adjacent to said cathodes; and a second grid adjacent to said first grid;

wherein said second grid consists of a plurality of split grids spaced apart from each other in the traveling direction of electron beams, and a plurality of beam apertures are formed, per cathode, in each of said first and second grids, and the beam apertures in at least one of the plural split grids constituting said second grid are positionally eccentric to those in another split grid.

2. The inline type electron gun according to claim 1, wherein the beam apertures formed in one of the plural split grids constituting said second grid are vertically eccentric, and the beam apertures formed in another of said plural split grids are horizontally eccentric.

3. A color cathode ray tube having an inline type electron gun which comprises three cathodes, a first grid adjacent to said cathodes, and a second grid adjacent to said first grid; wherein said second grid consists of a plurality of split grids spaced apart from each other in the traveling direction of electron beams, and a plurality of beam apertures are formed, per cathode, in each of said first and second grids, and the beam apertures in at least one of the plural split grids constituting said second grid are positionally eccentric to those in another split grid.

4. The color cathode ray tube according to claim 3, wherein the beam apertures formed in one of the plural split grids constituting said second grid are vertically eccentric, and the beam apertures formed in another of said plural split grids are horizontally eccentric.

5. A display apparatus equipped with the color cathode ray tube, said cathode ray tube having an inline type electron gun which comprises three cathodes, a first grid adjacent to said cathodes, and a second grid adjacent to said first grid;

wherein said second grid consists of a plurality of split grids spaced apart from each other in the traveling direction of electron beams, and a plurality of beam apertures are formed, per cathode, in each of said first and second grids, and the beam apertures in at least one of the plural split grids constituting said second grid are positionally eccentric to those in another split grid.

6. A display apparatus equipped with the color cathode ray tube according to claim 5, wherein a voltage of a waveform synchronized with a deflection period is impressed to at least one of the plural split grids constituting said second grid.

7. A display apparatus equipped with the color cathode ray tube according to claim 5, wherein, with regard to the plural split grids constituting said second grid, a voltage of a waveform synchronized with a deflection period is impressed to one of said split grids, while a voltage of another waveform synchronized with the deflection period is impressed to another of said split grids, and the waveforms of said two voltages are controlled independently of each other.

* * * * *

UNITED STATES PATENT AND TRADEMARK OFFICE

CERTIFICATE OF CORRECTION

PATENT NO. : 6,414,424 B1
DATED : July 2, 2002
INVENTOR(S) : Yasunobu Amano

It is certified that error appears in the above-identified patent and that said Letters Patent is hereby corrected as shown below:

Title page,
Item [54], should read:
-- ELECTRONIC GUN INCLUDING PLURALITY OF SPLIT GRIDS AND PLURALITY OF BEAM APERATURES PER CATHODE, COLOR CATHODE RAY TUBE, AND DISPLAY APPARATUS USING THE SAME --

Signed and Sealed this

Twenty-eighth Day of January, 2003

JAMES E. ROGAN
*Director of the United States Patent and Trademark Office*